United States Patent [19]

Sivilotti

[11] 4,055,474

[45] Oct. 25, 1977

[54] PROCEDURES AND APPARATUS FOR ELECTROLYTIC PRODUCTION OF METALS

[75] Inventor: Olivo Giuseppe Sivilotti, Kingston, Canada

[73] Assignee: Alcan Research and Development Limited, Montreal, Canada

[21] Appl. No.: 630,459

[22] Filed: Nov. 10, 1975

[51] Int. Cl.[2] ..... C25C 3/04

[52] U.S. Cl. ..... 204/70

[58] Field of Search ..... 204/70, 243, 247

[56] References Cited

U.S. PATENT DOCUMENTS

| | | | |
|---|---|---|---|
| 3,028,324 | 4/1962 | Ransley | 204/243 R |
| 3,067,124 | 12/1962 | De Pava | 204/243 R |
| 3,909,375 | 9/1975 | Holliday | 204/70 |

*Primary Examiner*—John H. Mack
*Assistant Examiner*—H. A. Feeley
*Attorney, Agent, or Firm*—Cooper, Dunham, Clark, Griffin & Moran

[57] ABSTRACT

A cell for electrolysis of magnesium chloride in a molten salt bath to produce magnesium metal and chlorine gas, having downwardly tapering graphite anodes with opposed major surfaces slanting throughout their vertical extents, and cathodes disposed in spaced, upwardly divergent slanting relation to the anode surfaces. Electrolytic production of the metal is effected by passing current between the facing anode and cathode slanting surfaces through the bath, which is essentially nonreactive with the carbon of the graphite anodes.

8 Claims, 6 Drawing Figures

Fig. 4
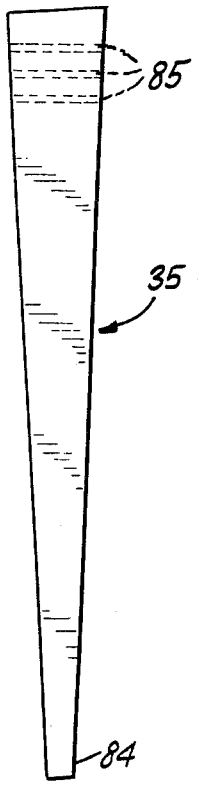
Fig. 5.
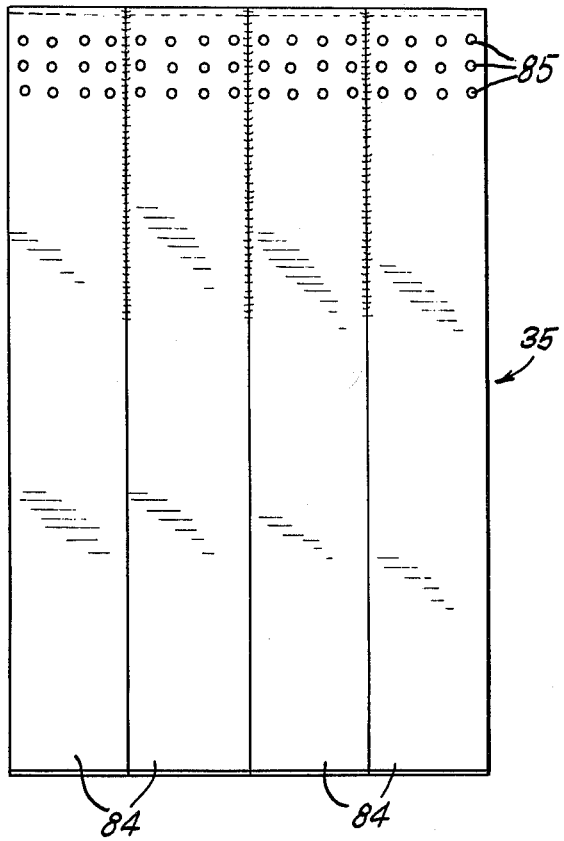
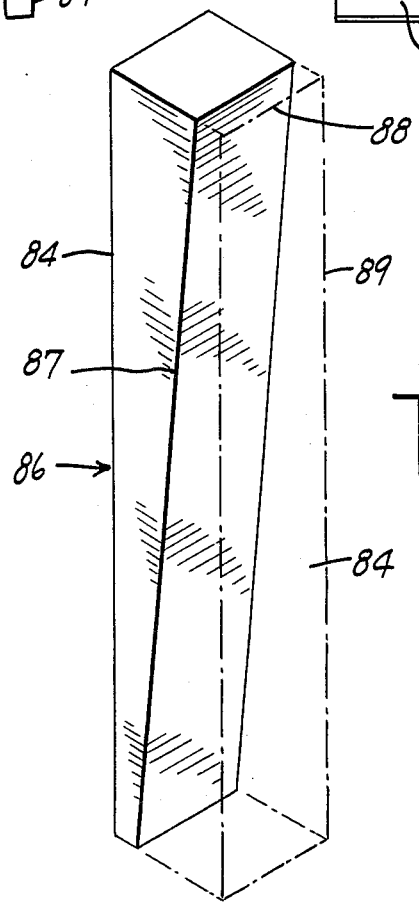
Fig. 6.

PROCEDURES AND APPARATUS FOR ELECTROLYTIC PRODUCTION OF METALS

BACKGROUND OF THE INVENTION

This invention relates to procedures and apparatus for electrolytic production of metals in a molten bath, wherein a molten metal lighter than the bath is released at cathode surfaces in the bath while a gas that must be kept from contact with the released metal is generated at anode surfaces in the bath.

In an important specific aspect, the invention is directed to the production of magnesium metal by electrolysis of a magnesium halide, such as magnesium chloride, to which particular reference will be made herein for purposes of illustration. Examples of structures and methods employed for such production of magnesium are disclosed in U.S. Pat. No. 2,785,121, issued March 12, 1957 on an application of A. H. Johnston, and U.S. Pat. No. 3,396,094, issued Aug. 6, 1968 on an application of O. G. Sivilotti et al.

As described in these patents, metallic magnesium may be produced by passing direct electric current between anodes and cathode suspended in facing spaced relation in a molten salt bath, containing magnesium chloride, within an enclosed cell chamber. The current heats the bath to maintain it at a temperature at least above the melting point of magnesium, and effects electrolysis of magnesium chloride in the bath, causing molten magnesium metal to be released at the cathode surfaces while chlorine gas is generated at the anode surfaces. The metal, being lighter than the bath, rises along the cathode surfaces, while the gas rises through the bath in a plume of bubbles from each anode surface to collect in a gas space within the chamber above the level of the bath. Extending above each cathode, but beneath the surface of the bath, is an inverted trough for receiving the rising metal and conducting it to a suitable collection locality external to the main cell chamber. Throughout this process, it is important that the released metal be kept isolated from the evolving gas, to prevent recombination of magnesium and chlorine that would decrease the production of metal, i.e. by returning metal to the bath as magnesium chloride, with resultant impairment of efficiency of the operation. The described procedure may be effectively continuous, e.g. with periodic replenishment of the magnesium chloride content of the bath, removal of product metal from the collecting locality, and withdrawal of chlorine gas from the chamber.

Typically the anodes are fabricated of graphite, while the cathodes may be steel plates. In some instances, the bath employed is reactive with carbon of the graphite anodes (chiefly owing, as presently believed, to the presence of water of crystallization with the magnesium chloride in the bath), and causes progressive consumption of the anodes with resultant tapering of the anode lower ends, although the anodes are formed with vertical sides and remain verticalsided above the locality of this incidental tapering. It has heretofore been proposed, in such case, to orient the cathodes obliquely for the purpose of achieving parallelism with the inherent taper of the lower end portions of the anodes undergoing consumption. It is, however, widely preferred to use a bath (e.g. an anhydrous salt mixture) that is essentially free of substances that react with the anode carbon, in order to avoid the expense and inconvenience of the progressive downward feeding or frequent replenishment of the anodes that is necessary if the anodes are being progressively consumed. When a nonreactive bath is employed, the spaced, facing major surfaces of the anodes and cathodes are conventionally oriented vertically and in parallel relation to each other, throughout the vertical extent of the cell.

The spacing between the facing cathode and anode surfaces, in such a cell, is determined by the requirement that the released metal flowing upwardly along the cathode surfaces be kept away from contact (and consequent recombination) with the plume of gas liberated at the anode surfaces. That is to say, it is necessary that the surface of a cathode be sufficiently far from the facing surface of an anode so that, at every portion of the cathode surface over which the rising metal flows, the metal is safely isolated from the anode gas plume. Thus, in practice, the facing electrode surfaces must be spaced relatively far apart.

SUMMARY OF THE INVENTION

An object of the present invention is to provide new and improved procedures and apparatus for electrolytic operations of the type exemplified by the above-mentioned electrolysis of magnesium chloride, enabling significant reduction in anode-cathode spacing as compared to conventional practice, with maintained isolation of metal released at the cathode from gas generated at the anode.

Stated with reference to electrolysis of magnesium chloride, it is found that reduction in anode-cathode spacing enables operation at advantageously low voltages, with substantial reduction in kilowatt hours of electricity required per pound of magnesium produced. Other advantages of reduction in anode-cathode spacing include improved conditions of upward flow of electrolyte between the anode and cathode, such as enhanced flow velocity and decreased turbulence. Heretofore, however, as explained above, in cells utilizing wholly or partially vertical-sided electrodes, relatively large anode-cathode spacing has been necessary to avoid recombination of the metallic and gaseous electrolysis products.

The present invention embraces the discovery that anode-cathode spacing can be advantageously reduced, in an electrolytic operation of the type described, by providing an anode and cathode with facing major surfaces so oriented that the anode major surface slants upwardly toward the cathode, and the cathode major surface slants upwardly away from the anode, at appreciable angles to the vertical, throughout the full active vertical extents of the surfaces. As used herein, the term "active vertical extent" refers to that portion of an electrode major surface which is positioned is directly opposed relation to a facing surface of an electrode of opposite polarity and in exposure to electrolyte.

Again referring to the electrolysis of magnesium chloride, in a cell having vertical-sided electrodes, the chlorine gas liberated at an anode surface rises therefrom through the electrolytic bath in an upwardly spreading plume of bubbles having a reasonably well defined outer limit (herein termed an envelope, it being understood that the envelope is simply the natural locus of outermost gas bubble travel and not a physical barrier) that slants outwardly and upwardly from the anode surface with a slope of about 9:1 to about 11:1, commonly about 10:1, the slope being expressed as ratio of vertical displacement to horizontal displacement. It has now been found that if the anode surface is slanted outwardly and upwardly (i.e. in a direction tending to decrease the distance between the upper portion of that surface and the envelope of the gas plume), the slope and location of the gas plume envelope does not change materially, at least so long as the anode surface slope remains somewhat greater than the slope of the envelope. Thus, considering a vertical cathode surface disposed in facing relation to a vertical anode surface and at a distance therefrom sufficient to keep upwardly flowing metal on the cathode surface out of contact with gas of the plume rising from the anode, slanting of the anode surface outwardly and upwardly (without change in position of the lower margin of that surface) as just described reduces the distance between the upper portions of the facing anode and cathode surfaces, without exposing metal on the cathode of the gas. Further in accordance with the invention, since the plume is widest at the top, the facing cathode surface may be slanted (from a fixed position of its upper margin) downwardly and inwardly toward the anode, e.g. with a slope such that the cathode surface is substantially parallel to the envelope, to reduce the distance between the lower portions of the facing anode and cathode surfaces, again without exposing released metal on the cathode to the gas.

In other words, when conventional vertical-sided electrodes are used, the facing anode and cathode surfaces must be spaced apart, throughout their full vertical extent, by a distance greater than the full horizontal distance between the envelope of the upwardly diverging plume and the vertical anode surface at the top of its active vertical extent; the present invention affords reduction in anode-cathode spacing by slanting the anode and cathode surfaces throughout their active vertical extents so that they more nearly approach parallelism with the slanting envelope, i.e. thereby reducing the distance between the upper portion of the anode surface and the envelope, and taking advantage of the discovery that some degree of outward slanting of the anode surface may be effected without altering the slope and position of the envelope.

In a process sense, then, the invention contemplates passing direct current through an electrolyte bath between anode and cathode surfaces respectively slanting as described above throughout their active vertical extents, in electrolytic procedure for releasing at the cathode a molten metal lighter than the bath while generating gas at the anode. Again, in an apparatus sense, the invention contemplates the provision of a cell including anode and cathode elements with facing surfaces slanting as described. Preferably, for electrolysis of magnesium chloride, the slope of the anode surface is between about 15:1 and about 20:1, while the slope of the cathode surface is not more than about 10:1. The minimum attainable anode-cathode spacing (i.e. with maintained avoidance of contact between molten metal and gas) decreases as these slopes approach the slope of the envelope; since the anode surface slope must be greater than that of the envelope, while the cathode surface slope is not more than about equal to that of the envelope, there is some degree of upward divergence between the slanting anode and cathode surfaces, but the invention enables substantial reduction in anode-cathode spacing (as compared with conventional practice) throughout the full active vertical extents of these surfaces, with the attendant advantages mentioned above.

In important specific aspects, the invention is particularly concerned with production of magnesium metal by electrolysis of magnesium chloride, and contemplates use of electrodes having the aforementioned slanting surface orientations, for electrolysis for magnesium chloride, with a molten electrolytic bath that is essentially free of substances that react with the material (e.g. graphite) of the anodes. The electrode arrangement of the invention may, for example, be incorporated in a cell of the type disclosed in the abovecited U.S. Pat. No. 3,396,094.

As a further particular feature of the invention, the anode (or each of plural anodes if, as is commonly the case, a plurality of parallel electrodes are included in a cell) is formed with two oppositely facing major surfaces each slanting upwardly and outwardly (with respect to the vertical plane longitudinally bisecting the anode) at a slope as defined above; and a pair of cathodes are provided, with major surfaces respectively disposed in facing spaced relation to the two anode surfaces and slanting in accordance with the invention. Thus, in transverse vertical section, the anode tapers downwardly, being thickest at its upper portion. Additional advantages inhere in this tapered anode configuration, e.g. as embodied in a solid graphite anode. For instance, current flow is efficient, because the anode is thickest where the current is highest; and the anode configuration tends to enhance the useful lifetime of the anode, for a given quantity of anode material used, because the anode is thickest at the locality (the top) where the possibility of deterioration, as by oxidation of anode material, is greatest.

Also in accordance with the invention, the lower margin of each cathode major surface may be curved outwardly (away from its associated anode) about a horizontal axis. This edge shape provides a Venturi-like effect between the curved cathode edge and the adjacent anode, promoting turbulent-free circulation of electrolyte by increasing upward flow velocity into and through the space between facing anode and cathode surfaces.

In particular, electrolytic operations embodying the invention are found to provide the advantages of low voltage requirements (as compared to conventional operations), efficient heat extraction (the tapered graphite anodes are at relatively low temperature and thus have reduced susceptibility to oxidation), and an advantageous combination of low power consumption with high current efficiency. Current efficiency, measured as the ratio of the actual weight of metal produced to the theoretical weight of metal obtainable with the current used, is important in that increased efficiency enables use of a smaller and lighter cell structure for a given output of metal.

Further features and advantages of the invention will be apparent from the detailed description hereinbelow set forth, together with the accompanying drawings.

BRIEF DESCRIPTION OF THE DRAWINGS

FIG. 4 is a front elevational view of one anode for the cell of FIG. 1;

FIG. 5 is a side elevational view of the anode of FIG. 5; and

FIG. 6 is a perspective view of a graphite block illustrating a step in fabrication of an anode as shown in FIGS. 4 and 5.

DETAILED DESCRIPTION

The invention will be shown and described as embodied in procedure and apparatus for producing metallic magnesium by electrolysis of magnesium chloride, in a cell having the general arrangement disclosed in the aforementioned U.S. Pat. No. 3,396,094, to which reference may be made for details and features of operation not set forth herein.

Figure 1:
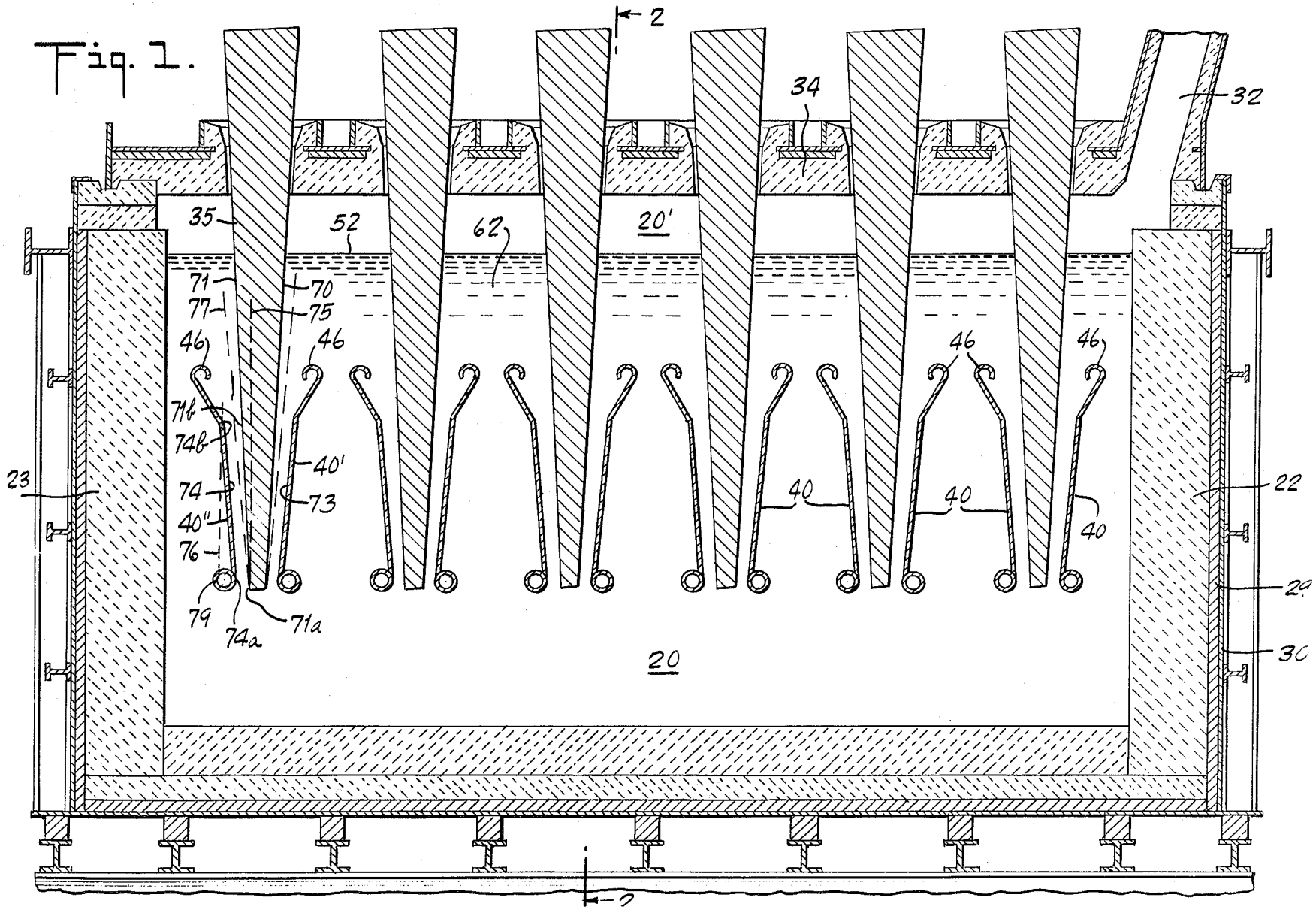
FIG. 1 is a sectional front elevational view of a magnesium chloride electrolysis cell embodying the present invention in a particular form.
Figure 2:
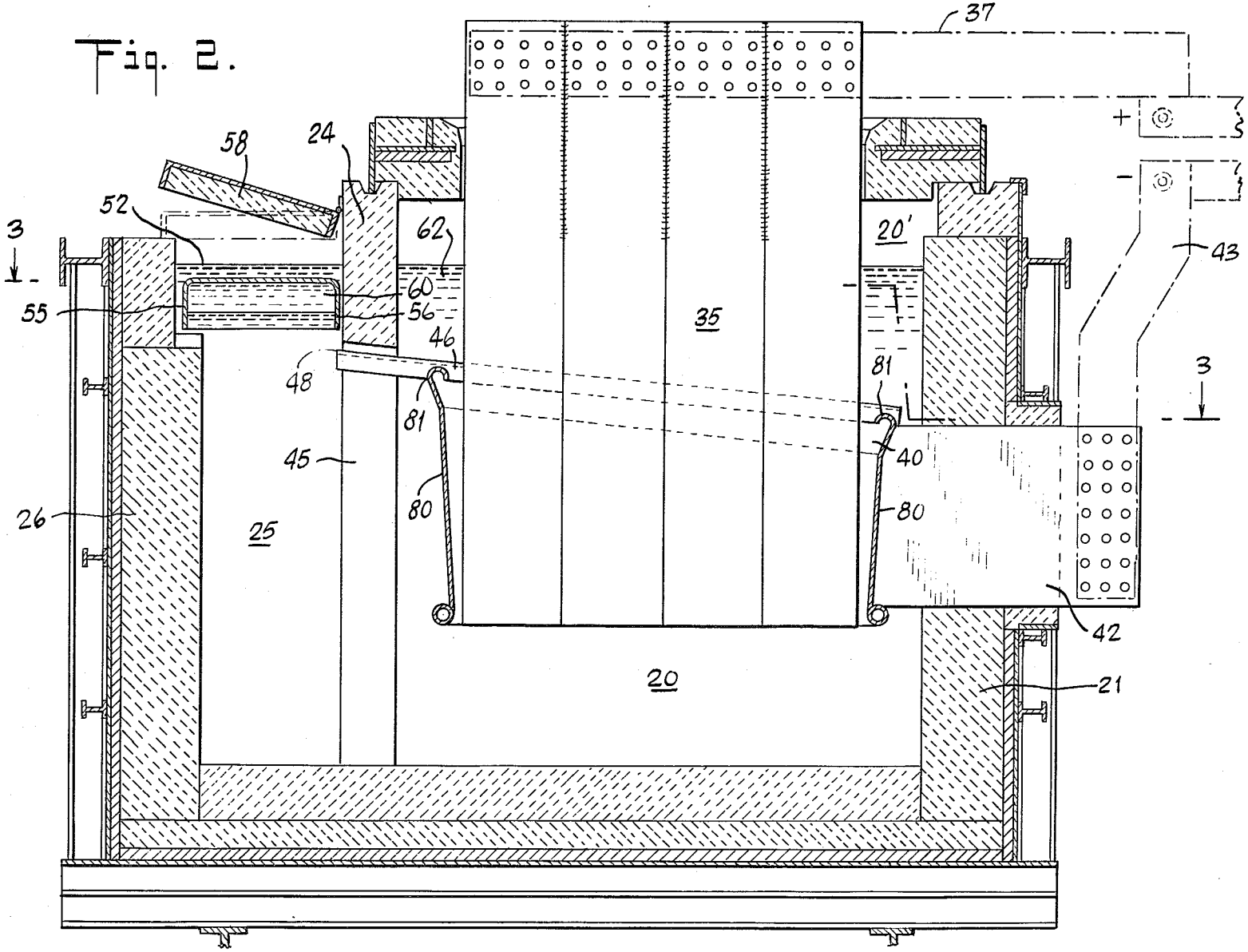
FIG. 2 is a sectional side elevational view of the cell, taken along the line 2—2 of FIG. 1.
Figure 3:
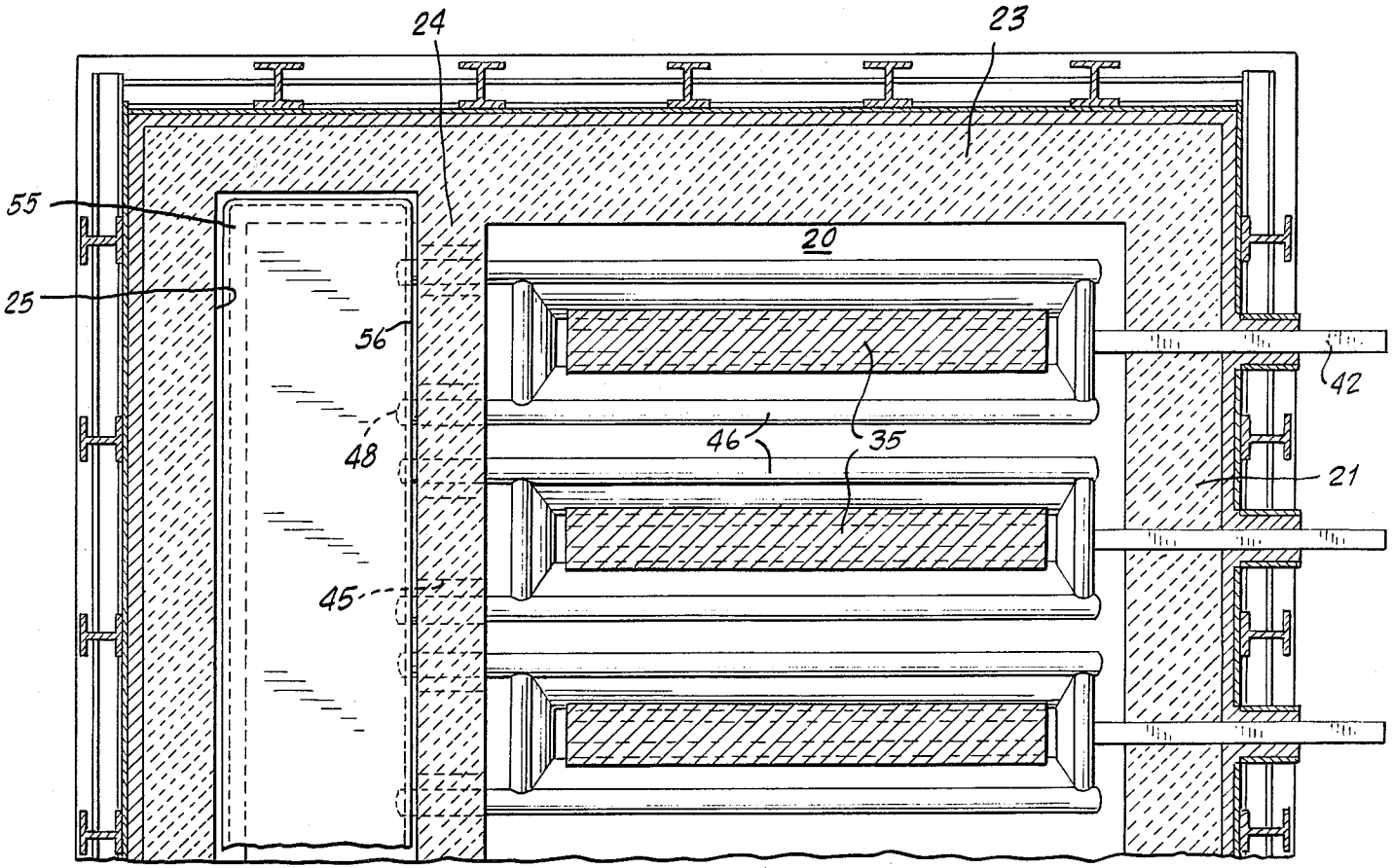
FIG. 3 is a fragmentary sectional plan view of the cell, taken along the line 3—3 of FIG. 2.

Referring to FIGS. 1, 2 and 3, the illustrated cell structure is rectangular in shape and includes a main chamber 20 having a rear wall 21 along its longer dimension in plan, and end walls 22, 23, the front side of the chamber 20 being bounded by a partition or curtain wall 24. Along the outer face of the partition wall a collecting or supplemental chamber 25 extends, being bounded at the ends by continuations of the wall 22, 23 and along its front side by a wall 26. All of the walls 21 to 26 inclusive, as well as the floor 27 under the entire cell, are made of heavy refractory construction, being conveniently built of refractory blocks (not shown as such) built up as masonry. The entire structure may have an outer insulating layer 29, and an outermost steel casing 30 for strength and protection.

The main chamber 20 has an outlet duct 32 near the top of one end wall 22, for withdrawal of chlorine gas, and is enclosed at the top by a removable, refractory lined cover 34, preferably seated in gas-tight sealed relation over the chamber.

A plurality of heavy, plate-like graphite anodes 35 are mounted in the cover so as to project downward into the chamber 20 with their lower edges near the bottom of the latter and each in such position that its long dimension extends from front to rear of the compartment. Appropriate electrical connecting means 37 are provided at the upper ends of the anodes, and in addition, means e.g. of conventional character (not shown) may be provided for extracting heat from the anodes. The cell also includes a plurality of cathodes 40, which may consist of steel plates, the cathodes being arranged at localities between successive anodes so that the electrodes alternate, in mutually parallel array along the main chamber 20, each extending substantially from the rear to the front walls of the chamber. The cathodes 40 that are disposed between pairs of anodes 35 are themselves arranged in spaced pairs as shown in FIG. 1 and are carried by suitable mounting and electrical connecting structure 42 which extends through the rear wall 21 and has electrical connection means 43. The cathodes of each described pair are thus disposed suitably close to the respectively adjacent anodes 35. At the ends of the cell, single cathodes 40 are provided, each similarly supported and connected through the rear wall of the cell and arranged in suitable proximity to the adjacent anode 35.

To permit discharge of molten metal which deposits on the cathodes and flows upwardly, the curtain wall 24 has appropriate openings, which are conveniently in the form of doorways 45, i.e. opening from a level somewhat above the cathodes, all the way down to the floor of the cell to allow a free flow of the bath between the man compartment 20 and the collecting chamber 25 for the purpose of enhancing metal and heat conveyance into the collecting chamber 25.

For actual conveyance of molten magnesium into the compartment 25, inverted trough-like structures 46 are provided in association with the cathodes, having portions which extend through the openings 45 of the curtain wall and which slope upwardly from the rear wall 21 to spout portion 48 on each, inside the chamber 25.

In operation, the chambers 20 and 25 of the cell are filled with fused bath to a level 52 well above the tops of the doorways 45, i.e. near the top of the outer wall 26. It will be understood that such bath may be composed of a magnesium halide, together with other salts appropriate as a vehicle and for establishment of desired conditions of melting point, fluidity and the like, all in accordance with well known practice in the art of electrolytic production of magnesium from a molten electrolyte. More particularly, the magnesium salt is commonly magnesium chloride, the remaining constituents of the bath being other chlorides such as sodium and calcium chlorides, to which may be added a small amount of a fluoride, i.e. calcium fluoride. The magnesium chloride, which constitutes the source of the magnesium metal product, is usually maintained in minor proportion, the remaining salts serving to provide desired fluidity and conductivity. As an example, appropriate for operations described herein, including the use of the present invention, one satisfactory bath consists essentially of about 15% magnesium chloride, 30% calcium chloride, 50% sodium chloride, together with a small amount of calcium fluoride, i.e. 5% or less, all quantities being expressed by weight. The bath constituents are anhydrous, and the bath is essentially free of substances that react with carbon of the graphite anodes, so that there is essentially no consumption of the anodes during operation, at least in any progressive or continuing sense.

With a suitable source of direct current connected to the means 37, 43 so that electrical energy is supplied in the circuit and particularly in the path from the anodes 35 through the molten bath to the cathodes 40, electrolysis proceeds, consuming the magnesium chloride in the bath and releasing chlorine at the anodes and metallic magnesium at the cathodes. The chlorine collects in gaseous form in the space 20' at the top of the main chamber 20, for discharge through the port 32, while the magnesium metal is deposited in molten state on the exposed cathode surfaces, flowing upwardly (because it is lighter than the bath) and collecting at the underside of the troughs 46. The magnesium metal is thus guided by the troughs and spouts 48 into the collecting and charging chamber 25. It will be understood that the bath is maintained in fused condition (and at a temperature at least above the melting point of magnesium metal) by the heat of electrolytic operation, i.e. the passage of current. Procedures for starting and operating the cell, as well as for adding charge of magnesium chloride from time to time, may be generally such as are known or understood in the art.

An elongated reservoir or collecting box 55 is provided near the top of the collecting chamber 25, extending substantially the entire length of the chamber between the end walls 22, 23. While other configurations of constructions, or other materials, may be employed in some cases, an especially convenient arrangement consists of a long, inverted sheet metal box, made of ordinary steel or the like, having a rear, vertical wall 56 which extends along the curtain wall 24 above the doorways 45. The underside of the box or reservoir 55 is open at least at regions adjacent the wall 24.

It will now be seen that the elongated, inverted box 55 is disposed so that the spouts 48 of the metal-advancing troughs 46 open into the bottom of the box. The entire structure of the reservoir 55 is disposed so that it lies wholly beneath the surface 52 of the bath. One end (not shown) of box 55 is arranged to be openable for access from above, e.g. through a suitable tapping assembly (also not shown) for periodic removal of accumulating molten magnesium from the box; fresh electrolyte material, including additional quantities of magnesium chloride for electrolysis, may be charged to the cell through the same opening. Details of construction and arrangement of the box 55 and associated tapping means are shown and described in the aforementioned U.S. Pat. No. 3,396,094.

Cover means may also be provided for the collecting compartment 25 or parts of it such as the tapping well. One effective structure is constituted by a refractory lined, steel jacketed cover 58, hinged about a horizontal axis along the face of the cell wall 24, and arranged to be closed down in covering relation to the entire side chamber 25 of the cell. It has been found that such a structure not only reduces oxidation and other contamination of the bath, and effectively conserves heat, but also provides a convenient means of adjusting the cell temperature. Thus if the bath is found to have a temperature above a range or value regarded as optimum for cell operation, e.g. 680° C., the cover is raised until the cooling action of the air on the exposed bath surface 52 brings the temperature to the stated, desired value.

Similar temperature controlling effects could be obtained by other thermostatic devices; for example, by an immersion heat exchanger of suitable tubular shape to circulate a cooling fluid such as air under the control of a manual or a temperature sensitive automatic valve. In such a case the refractory lined cover may be left closed in a sealed relationship with the side chamber 25, except for two small access openings for feeding and tapping, obtaining a further improved control of oxidation and other contamination of the free surface of side chamber 25.

The described arrangement of box 55 provides an enclosed, submerged reservoir for collection of the molten metal product. In operation of the cell, with current flowing between anodes and cathodes, magnesium is deposited in molten form at the cathodes, rising to the inverted troughs 46 and running forward, via the spouts 48, so as to discharge upwardly within the reservoir 55. The metal (being lighter than the bath) collects as a layer 60 directly against and under the top of the reservoir, becoming deeper as more metal is produced.

The molten bath 62 is at all times maintained at a level well above the reservoir (within the refractory cell walls, which extend substantially above the top of the reservoir), so that there is neither exposure of the metal to the air nor exposure of any substantial extent of metal structure which is in contact with the metal, and thus there is no need for a relatively high bath temperature to keep the metal surface from freezing. In consequence the cell is operated at a substantially lower temperature than might otherwise be possible, and corresponding improvement in efficiency is achieved. All tapping is accomplished through the tapping means, and charge of the cell is effectively achieved through the same tapping means.

The apparatus as thus far described is generally similar to that shown in the aforementioned U.S. Pat. No. 3,396,094. Features of the present invention as embodied in the illustrated apparatus reside in the specific structure and arrangement of the anodes 35 and cathodes 40, as will now be explained. Each of the anodes 35 is, as stated, a relatively large and flat-sided solid graphite structure having two opposed planar major surfaces 70 and 71 respectively facing the two side walls 22 and 23 of the chamber. Two of the steel plate cathodes 40 are associated with each anode, being respectively disposed on opposite sides of the anode and in spaced, generally parallel relation thereto as that they respectively face the two anode major surfaces; i.e., referring to the anode 35 shown on the left-hand side of FIG. 1, a first one of the cathodes (designated 40') associated therewith has a planar major surface 73 disposed in facing spaced relation to the anode major surface 70 while the second cathode (designated 40'') assocated with the same anode has a planar major surface 74 disposed in facing spaced relation to the anode major surface 71.

Each cathode extends horizontally (from back to front of the cell chamber 20) for a distance substantially equal to the extent of its associated anode in the same direction; and each cathode extends vertically upwardly from about the level of the lower end of its associated anode to a higher level that is at least somewhat below the level 52 of the molten bath. In this embodiment, the active vertical extent of each anode major surface may be considered as that portion of the surface lying between the lower end of the anode and the upper level to which the facing cathode extends, while the active vertical extent of each cathode major surface includes the entire cathode surface. In other words, referring to the major surface 71 of the left-hand anode 35 in FIG. 1, the major vertical extent of anode surface 71 lies between the lower end **71*a* of that surface and a point 71*b* at the level of the upper extremity of the facing cathode major surface 74; the active vertical extent of major cathode surface 74 may be taken as lying between the lower extremity 74*a* and the upper extremity 74*b*** of that surface.

In accordance with the invention, for minimization of anode-cathode spacing with maintained avoidance of contact between metal released at the cathode and gas released at the anode, each major surface 70 and 71 of each anode slants upwardly and outwardly (i.e. toward the cathode facing that surface), at least throughout its active vertical extent, at an appreciable angle to the vertical, and each cathode major surface 73 or 74 slants upwardly, throughout its entire vertical extent, away from the facing major surface of its associated anode, also at an appreciable angle to the vertical which is somewhat greater than the angle of the anode surfaces. Preferably, the slope of the anode major surfaces is between about 15:1 and about 20:1, while the slope of the cathode major surfaces is not more than about 10:1. In the illustrated embodiment of the invention, and with special advantages hereinafter further explained, each anode major surface slants uniformly throughout its vertical extent with a slope of about 20:1, while each cathode major surface slants uniformly throughout its vertical extent with a slope of about 10:1, the anode major surfaces slanting (as stated) upwardly toward the facing cathodes while the cathode major surfaces slant upwardly away from the facing anodes. Thus the anodes, viewed in transverse vertical cross section (FIG.

1) taper uniformly downward from top to bottom, and the cathode major surfaces are oriented in upwardly diverging relation to the anode major surfaces.

In further explanation of these features of the invention, reference may be made to a comparison between the illustrated surface orientation of the invention and that of a conventional cell wherein facing anode and cathode major surfaces are oriented in spaced, parallel vertical planes. Looking again at the left-hand anode 35 in FIG. 1, broken line 75 represents a conventional vertically oriented anode major surface having its lower edge coincident with the lower edge 71*a* of the illustrated anode major surface 71. Broken line 76 represents a conventional vertically oriented cathode major surface facing surface 75 and having its upper edge coincident with the upper extremity 74*b* of the illustrated cathode major surface 74. In a conventional arrangement of electrodes with facing vertical surfaces as indicated at 75 and 76, chlorine gas evolved at the anode surface rises upwardly therefrom through the molten bath 62 in an upwardly spreading plume of bubbles lying substantially entirely within a region bounded by a plane represented by broken line 77. As shown, plane 77 (hereinafter referred to as the envelope of the gas plume) diverges upwardly from the conventional vertical anode surface 75 with a slope of between about 9:1 and about 11:1, commonly about 10:1. Thus, in an upward direction, envelope 77 progressively approaches the conventional vertical cathode surface 76.

In order to prevent the evolved gas from coming into contact with magnesium metal flowing upwardly on conventional vertical cathode surface 76 (i.e. to prevent recombination of the released metallic magnesium with chlorine), it is necessary that the upper edge of surface 76 (coincident with edge 74*b*) be spaced outwardly of envelope 77 (with respect to the anode) by a predetermined distance. In the conventional vertical electrode arrangement represented by lines 75 and 76, then, the horizontal spacing between surfaces 75 and 76 (throughout their mutual vertical extent) must be the sum of that predetermined distance and the full width of the gas plume (i.e. the horizontal distance between surface 75 and envelope 77) at the level of the cathode surface upper edge 74*b.*

It has now been found that as long as the lower edge 71*a* of the anode major surface remains in a fixed position, the surface may be slanted appreciably outward (toward the facing cathode) without materially changing either the slope or position of the envelope 77 that marks the outer limit of gas rising from that anode surface. The slope of the slanting anode surface should remain somewhat greater than the slope of the envelope, but with an envelope slope of about 10:1, the anode surface may depart from the vertical by as much as a slope of 15:1, although a slope of about 20:1 represents a presently preferred or practical value for the anode surface slope.

It will be seen that as the anode surface is thus slanted, diverging from line 75 but with the lower edge 71*a* remaining in the same position, the distance between the cathode surface upper edge 74*b* and the corresponding point 71*b* on the anode surface decreases (while the spacing between cathode surface edge 74*b* and plume envelope 77 remains the same) since the outward slant of the anode surface decreases the horizontal distance between envelope 77 and the anode surface at the level of edge 74*b.* If the cathode major surface is now slanted away from vertical 76 into approximate parallelism with envelope 77 (leaving the upper edge 74*b* unchanged in position), the cathode surface edge 74*a* is brought closer to the anode surface lower edge 71*a,* yet throughout its vertical extent, the slanted cathode surface is spaced outwardly of envelope 77 by the aforementioned predetermined distance sufficient to prevent contact and recombination of released magnesium and chlorine.

Thus it will be understood that the slanting orientation of the facing major surfaces 71 and 74 of the anode and cathode, respectively, departing from the conventional vertical positions of lines 75 and 76, affords significant reduction in anode-cathode spacing, yet (owing to the fact that the slope and position of envelope 77 are independent of anode surface slope, over a limited but useful range of values of anode surface slope) the desired avoidance of recombination of released magnesium and chlorine is unimpaired.

Further it will be understood that the minimum requisite spacing between anode and cathode facing surfaces is progressively reduced as the slopes of these surfaces approach parallelism with the envelope 77. Consequently, the presently preferred value for the slope of the cathode surfaces is about equal to the slope of the envelope. The slope of the anode surface must, as stated, be somewhat greater than the envelope slope; hence the facing anode and cathode surfaces are necessarily somewhat divergent in an upward direction. The anode and cathodes are preferably respectively disposed so that the facing anode and cathode surfaces are as close to each other as possible consistent with the requirement of avoidance of recombination of magnesium and chlorine; i.e. the major surface of each cathode is preferably spaced outwardly of the envelope 77 of the gas plume rising from the facing anode major surface, by a distance just sufficient to insure substantial avoidance of such recombination.

To promote upward flow of the bath between anode and cathode surfaces, the lower edge 74*a* of each cathode may, as shown, be curved outwardly (with respect to its associated anode) about a horizontal axis. This configuration may be provided be welding an axially horizontal cylindrical metal pipe section 79 along the lower edge of each cathode so that the axis of the pipe is parallel to the plane of the cathode major surface 74 and is disposed on the side of that surface away from the associated anode, i.e. with the planar surface 74 essentially tangent to the cylindrical surface of pipe 79. The outwardly curving lower edge configuration thus imparted to the cathodes provides a venturi-like effect in increasing the speed of upward flow of bath between the lower edge of the cathode and the adjacent low edge of the anode, contributing to desired relatively rapid upward flow of bath between the facing electrode surfaces with minimization of turbulence.

In the illustrated embodiment, the inverted, metal-collecting troughs 46 are formed integrally with the cathodes 40. The upper portion of each of the steel plate cathodes 40 is bent outwardly at the upper extremity of the cathode major surface (i.e. at 74*b* in cathode 40″), and the upper edge of this outwardly bent cathode portion is curved inwardly and downwardly about an axis extending along the length of the cathode as shown at 46 to form a horizontal inverted trough with a cylindrical wall. This trough 46, as shown, opens downwardly (throughout the full horizontal extent of the cathode) toward the space between the cathode and the facing anode so that molten magnesium metal released at the cathode major surface and flowing upwardly along that surface (i.e. surface 74 in cathode 40'') is guided along the outwardly bent upper portion of the cathode into the trough 46, whence the metal can rise no further.

As best seen in FIG. 2, each inverted trough 46 slopes upwardly toward the collecting chamber 25 and terminates in an extension projecting through one of the doorways 45 into the collecting chamber, so that the tendency of the released molten metal to rise carries it along the sloping trough into the collecting chamber, where it emerges at spout 48 to rise into collecting box 55.

In their illustrated configuration and disposition, the troughs 46 at the tops of the cathodes 40 are shaped and positioned to avoid entrapment of gas in the troughs and to avoid carrying turbulence into the troughs.

If desired, cathodes 80 (similar in construction to the cathodes 40 already described) may be provided at each end of each anode 35 extending between the two cathodes 40 respectively disposed on opposite sides of such anode, and including inverted troughs 81 that communicate with the troughs 46 of the last-mentioned cathodes 40 so that metal released on the surfaces of the cathodes 80 is led to the troughs 46 and conducted into the collecting chamber 25.

A convenient construction for the anodes 35 is illustrated in FIGS. 4 – 6. As there shown, each of the anodes 35 may be fabricated of a plurality of vertically elongated graphite members 84, securely joined to each other along their facing, tapered side surfaces and with their major, vertically elongated rectangular surfaces in coplanar relation. A plurality of holes 85 are drilled through the upper portion of each of the members 84 to facilitate electrical connection of the anode to the connecting means 37.

The individual members 84 may be formed from elongated graphite blocks 86 of rectangular cross section, as shown in FIG. 6. Each block 86 is cut longitudinally on a diagonal to form two of the members 84. At each end of the block 86, the diagonal cut 87 is spaced inwardly from the adjacent side edge 88 of the block by a distance selected to provide sufficient thickness, at the lower end of the tapered anode, for maintained structural integrity of the anode in service. The slope of the diagonal cut 87, with respect to the longitudinal vertical edges 89 of the block 86, is one half the slope to be provided for the major surfaces of the ultimately produced anode; i.e. for an anode surface slope of 20:1, the diagonal cut 87 has a slope of 10:1 with respect to the block edges 89. An anode surface slope of about 20:1 is presently preferred in a practical sense, for providing a graphite anode that is neither unduly thick in its upper portion nor excessively thin at its lower extremity.

Each member 84, when cut, may be considered as having one elongated rectangular vertical face and one elongated rectangular face at a slope of about 10:1 to the vertical. When assembled with other members 84 to form an anode 35, and then mounted in a cell as shown in FIG. 1, the member 84 is so oriented that each of its major rectangular major surfaces has a slope of about 20:1, i.e. so that the anode tapers uniformly downward with the same slope at each of its opposite major surfaces.

Practice of the procedure of the present invention in the above-described apparatus for production of metallic magnesium by electrolysis of magnesium chloride may now be readily explained. With the cell filled to level 52 with a molten salt bath 62 containing magnesium chloride, direct electric current is passed through the bath between the facing slanting major surfaces of the anodes 35 and cathodes 40, i.e. from the electrical connections shown at 37 and 43. The continuous passage of this current causes electrolysis of the contained magnesium chloride in the bath, and concomitant heating of the bath to maintain it at least at a temperature above the melting point of magnesium. Free magnesium metal is deposited in molten state on the major, anode-facing surfaces of the cathodes, and flows upwardly along those surfaces to be received in the troughs 46 which conduct the metal to the collecting chamber 25. At the same time, chlorine gas is continuously evolved at each anode and rises from the anode in a plume defined by envelope 77 to collect in a gas space 20' of the gas-tight chamber 20 above the bath level 52. Molten metal is withdrawn, as product, from the collecting box 55, and additions (including fresh magnesium chloride for electrolysis) may be made to the bath e.g. through the same means (not shown) used for withdrawal of the product metal. Chlorine gas is withdrawn through conduit 32 e.g. for use as desired. Owing to the fact that the anhydrous bath is esentially free of substances that react with carbon of the graphite anodes, the anodes do not deteriorate, at least in any progressive or continuing sense, over extended operating periods. The fact that the anodes are thickest at their upper portion, where the likelihood of oxidation and/or other conditions contribution to deterioration is most severe, aids in the realization of a long useful lifetime for the anodes not-withstanding that, especially in the lower part of their active regions, they are relatively thin.

The advantageously close proximity of facing anode and cathode surfaces, in the procedure and apparatus of the invention as exemplified by the foregoing embodiments, together with the tapered configuration of the anodes, affords advantageously low voltage requirements and low power consumption with high current efficiency.

In an illustrative instance of production of magnesium metal from magnesium chloride by operation of an electrolytic cell in accordance with the present invention, between about six and about seven kilowatt hours of electricity were required per pound of magnesium produced, whereas in a comparable conventional cell having anodes and cathodes with vertically oriented facing surfaces, about nine to about ten kilowatt hours were required for each pound of magnesium produced.

In an illustrative example of an anode in accordance with the invention having the construction shown in FIGS. 4 – 6, a rectangular solid block of graphite 100 inches by 16 inches by 16 inches was cut diagonally (as shown in FIG. 6) in the direction of its long dimension at a slope of 10:1 (considering the long dimension of the block as being vertical) to produce two members 84 each tapering from a thick end 16 inches by 13 inches ± 1/16 inch in cross section to a thin end 16 inches by 3 inches ± 1/16 inch in cross section. Four of these members, each having 12 holes of 7/8 inch diameter drilled in its upper portion, were glued together in the arrangement shown in FIG. 5, glue being applied to the upper 35 inches of each joint between adjacent members. The finished anode, 64 inches wide and 100 inches long, was suspended in a cell with the originally vertical face of each member displaced 2°52' from the vertical so that each major surface of the anode is oriented at a slope of 20:1.

With this anode are mounted a pair of steel cathodes 40 in the arrangement shown in FIG. 1, each arranged with its major surface facing one of the anode major surfaces and slanting upwardly away from such surface with a slope of 10:1. The spacing between facing anode and cathode surfaces at their respective lower extremities is two inches. Thus, assuming that the vertical extent of the cathode (at a given point) is 40 inches, the anode-cathode spacing at the upper extremity of that extent is four inches. If conventional vertical-faced anodes and cathodes were used, provision of the same distance between the upper extremity of a 40-inch cathode and a gas plume (having an envelope with a slope of 10:1) rising from the anode surface would require that the facing vertical anode and cathode surfaces be spaced six inches apart throughout their active vertical extent.

It is to be understood that the invention is not limited to the features and embodiments hereinabove specifically set forth but may be carried out in other ways without departing from its spirit.

I claim:

1. Procedure for electrolysis of magnesium chloride to produce free magnesium metal, including the step of a. maintaining, in an enclosed cell chamber, a molten electrolytic bath containing magnesium chloride for electrolysis, free magnesium metal being lighter than said bath; and b. passing direct electric current through the bath between at least one anode and at least one cathode in contact with the bath for depositing free magnesium metal at said one cathode for upward flow along said cathode and evolving chlorine gas at said one anode for upward travel through said bath within an envelope diverging upwardly at a substantially constant slope;

wherein the improvement comprises:

c. said current-passing step comprising passing current through said bath between a major surface of said one anode that slants upwardly toward said one cathode throughout the active vertical extent of said one anode major surface with a slope greater than the slope of said envelope, and a major surface of said one cathode that faces and slants upwardly away from said one anode major surface throughout the active vertical extent of said one cathode major surface with a slope not more than about equal to the slope of said envelope, the lower extremity of the active vertical extent of said one cathode major surface being spaced from said one anode major surface by a distance sufficient to prevent contact and recombination of magnesium metal and chlorine gas respectively released at said last-mentioned cathode and anode surfaces, while maintaining a circulating flow of the bath directed entirely upwardly throughout a space defined between said last-mentioned cathode and anode surfaces and downwardly along a return flow path external to said space.

2. Procedure according to claim 1, wherein the slope of said one anode major surface is at least about 15:1 and the slope of said one cathode major surface is not more than about 10:1.

3. Procedure according to claim 2, wherein the slope of said one anode major surface is about 20:1 and the slope of said one cathode major surface is about 10:1.

4. Procedure according to claim 2, wherein said bath is essentially free of substances that react with material of said one anode.

5. Procedure according to claim 4, including the step of guiding flow of said bath upwardly, between said one anode and said one cathode, around a lower edge of said major surface of said one cathode curved about a horizontal axis parallel to said one cathode major surface and disposed on the side thereof away from said anode.

6. Procedure according to claim 4, wherein said one anode is fabricated of graphite and said bath is essentially free of substances that react with carbon of the graphite.

7. Procedure according to claim 4, wherein said one anode has two opposed major surfaces in contact with said bath and diverging upwardly, throughout the active vertical extent thereof, each having a slope of between about 15:1 and about 20:1, said one cathode major surface facing one of said anode major surfaces; and further including passing direct electric current between said one anode and a second cathode having a major surface facing and slanting upwardly away from the other of the anode major surfaces throughout the active vertical extent of said second cathode major surface at a slope of not more than about 10:1.

8. Procedure according to claim 4, including the step of collecting metal, flowing upwardly along said one cathode major surface, in an inverted trough extending through the bath adjacent and parallel to an upper edge of said one cathode major surface while preventing access of gas in said envelope to said trough and while preventing turbulence in said trough, for conducting said metal away from said chamber.

* * * * *